US011522265B2

(12) United States Patent
Rossman et al.

(10) Patent No.: US 11,522,265 B2
(45) Date of Patent: Dec. 6, 2022

(54) ROTATABLE ANTENNA DESIGN FOR UNDERSEA VEHICLES

(71) Applicant: BAE Systems Information and Electronic Systems Integration Inc., Nashua, NH (US)

(72) Inventors: Court E. Rossman, Merrimack, NH (US); Ronald M. Carvalho, Jr., Bedford, NH (US); John R. Stuart, III, New Boston, MA (US); Matthew D. Thoren, Pelham, NH (US); John M. Veilleux, Salem, NH (US); Ross J. Wendell, Medford, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/240,341

(22) Filed: Apr. 26, 2021

(65) Prior Publication Data

US 2022/0344793 A1 Oct. 27, 2022

(51) Int. Cl.

| | |
|---|---|
| ***H01Q 1/04*** | (2006.01) |
| ***H01Q 1/36*** | (2006.01) |
| ***H01Q 1/12*** | (2006.01) |

(52) U.S. Cl.
CPC ..... *H01Q 1/04* (2013.01); *H01Q 1/1221* (2013.01); *H01Q 1/36* (2013.01)

(58) Field of Classification Search
CPC ..... H01Q 1/04; H01Q 1/36; H01Q 1/1221
See application file for complete search history.

(56) References Cited

U.S. PATENT DOCUMENTS 6,847,282 B2 * 1/2005 Gomez ..... H01F 17/0013 336/84 R
2011/0250838 A1 10/2011 Alexopoulos et al.
(Continued)

FOREIGN PATENT DOCUMENTS

| | | | | |
|---|---|---|---|---|
| CN | 111361717 A | * | 7/2020 | ..... B63G 11/52 |
| JP | 2000299606 A | * | 10/2000 | ..... H01Q 21/06 |
| JP | 200955073 A | * | 3/2009 | ..... H03H 9/72 |

OTHER PUBLICATIONS

International Search Report, PCT/US22/26138, dated Jul. 26, 2022, 17 pages.

*Primary Examiner* — Hoang V Nguyen
(74) *Attorney, Agent, or Firm* — Finch & Maloney PLLC; Scott J. Asmus

(57) ABSTRACT

An antenna module configured for use on an underwater vehicle is disclosed. The antenna module includes an array of spiral antennas fabricated on a multi-layer substrate that provides wide-band RF communication with direction finding (DF) capability. The antenna module can also include other antennas fabricated on the same multi-layer substrate, such as one or more global positioning system (GPS) receivers, an ultra-high frequency/very-high frequency (UHV/VHF) antenna, or one or more iridium antennas. The antenna module may further include a water-proof housing that is coupled to the outside hull of an undersea vehicle via a coupling mechanism. The coupling mechanism allows the antenna module to rotate between a stowed position against the hull and a deployed position that extends the antennas out away from the undersea vehicle. The antenna module is curved or flexible so it can stow against a corresponding curved hull of the undersea vehicle.

18 Claims, 11 Drawing Sheets

(56) References Cited

U.S. PATENT DOCUMENTS

| | | | |
|---|---|---|---|
| 2016/0376000 | A1 | 12/2016 | Kohstall |
| 2018/0336993 | A1 | 11/2018 | Avuthu et al. |
| 2019/0253156 | A1 | 8/2019 | Rhodes et al. |
| 2020/0161776 | A1 | 5/2020 | McMahon et al. |

* cited by examiner

ROTATABLE ANTENNA DESIGN FOR UNDERSEA VEHICLES

BACKGROUND

Undersea vehicles face numerous challenges with regards to radio frequency (RF) communication. Since RF signals attenuate heavily through water, undersea vehicles typically rise up to the water's surface to transmit or receive RF signals. The antennas used on undersea vehicles typically operate in either vertical or horizontal polarization regimes, which can cause significant signal degradation due to the motion of the undersea vehicle imposed by the surrounding water. Antennas that could cover wider frequency bands and provide direction finding (DF) capability are too large to be incorporated on an undersea vehicle without severely impacting stability and maneuverability. This can especially present complications for an undersea vehicle carrying out covert activities.

BRIEF DESCRIPTION OF THE DRAWINGS

Features and advantages of embodiments of the claimed subject matter will become apparent as the following Detailed Description proceeds, and upon reference to the Drawings, in which:

Figure 1:
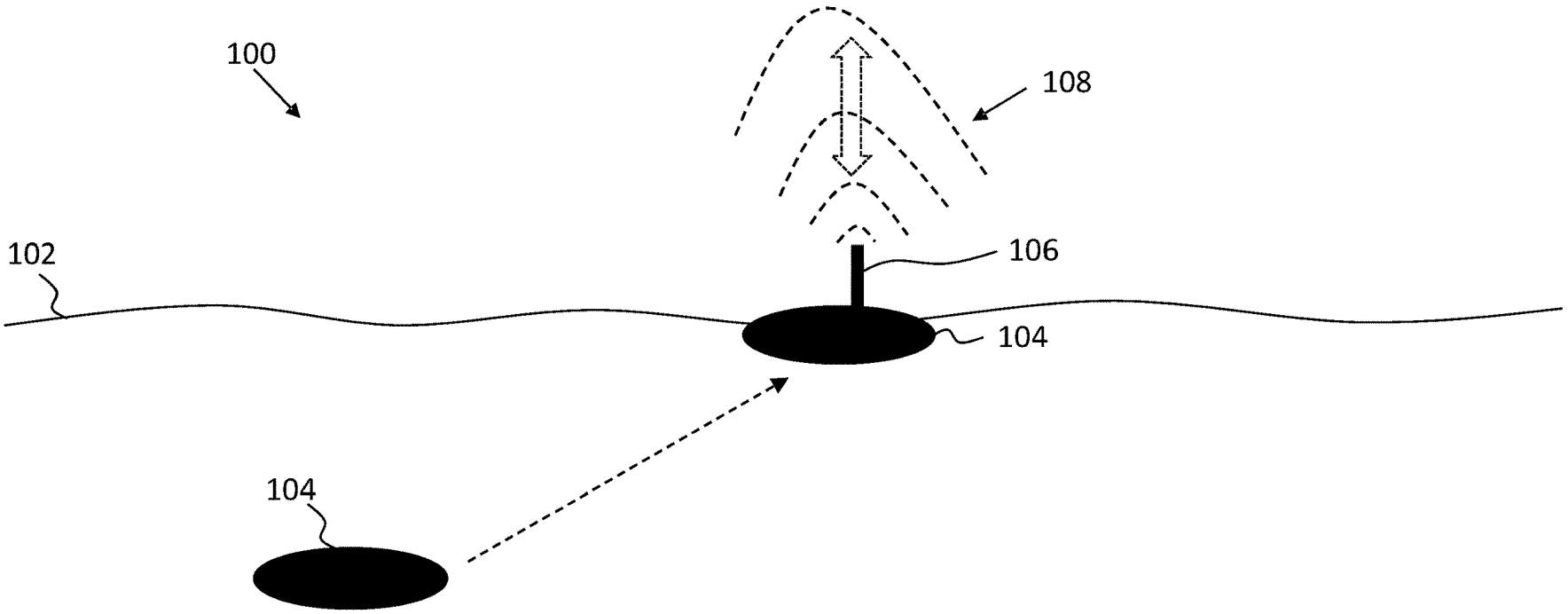
FIG. 1 illustrates an example undersea environment with an undersea vehicle configured with an antenna structure, in accordance with some embodiments of the present disclosure.

Although the following Detailed Description will proceed with reference being made to illustrative embodiments, many alternatives, modifications, and variations thereof will be apparent in light of this disclosure.

DETAILED DESCRIPTION

An antenna module configured for use on an undersea vehicle is disclosed. The antenna module includes an array of spiral antennas fabricated on a multi-layer substrate (or multiple substrates bonded together) and provides wide-band RF communication with direction finding (DF) capability. According to some embodiments, the antenna module also includes one or more other antennas fabricated on the same multi-layer substrate, such as one or more global positioning system (GPS) receivers, one or more ultra-high frequency/very-high frequency (UHV/VHF) antennas, or one or more iridium antennas. The antenna module includes a water-proof housing that surrounds and protects the various antennas. According to some embodiments, the housing around the antennas is coupled to the outside hull of an undersea vehicle via a coupling mechanism. The coupling mechanism allows the antenna module to rotate between a stowed position against the hull and a deployed position that extends the antennas out away from the undersea vehicle. According to some embodiments, the antenna module is curved such that it can stow against a corresponding curved hull of the undersea vehicle, thus reducing drag on the undersea vehicle when the antenna structure is in its stowed state. In the deployed state, the array of spiral antennas can be used to cover a wide band of RF communication frequencies up to, for example, 12 GHz. The undersea vehicle may deploy the antenna module and/or any other sensor structures above the water's surface to communicate via RF or optical signals, or to observe above-water activity with cameras, electro-optical infrared sensors, radar, or RF sensors. Once signal transmission/reception or other sensor-based activity is complete, the antenna module can be stowed back against the hull of the undersea vehicle such that the antenna module does not hinder movement of the undersea vehicle as it remains submerged and moves undersea.

Undersea vehicles, such as unmanned underwater vehicles (UUVs), are very useful for covert missions and/or to provide intelligence data from within areas of denied access. Antenna structures are thus important to include on such undersea vehicles to, for instance, intercept RF signals and/or broadcast RF signals back to a central station or ship. Integrating antenna structures on small underwater vehicles is problematic. For instance, existing antennas integrated within undersea vehicles are polarization dependent, generally narrow band and provide omni collection capabilities only. Vehicle hydrodynamics and stability have a significant impact on the antenna performance.

According to some embodiments of the present disclosure, the antenna module design disclosed herein alleviates or otherwise reduces the problems noted above with previous antenna designs. The antenna module is fabricated such that it can be contoured to the outside hull surface of the undersea vehicle in a stowed position and rotated outward to a deployed position when in use. Furthermore, the antenna substrate protected within the antenna module includes at least a series of planar spiral antennas that can provide fully polarimetric RF reception with fine bearing resolution at higher frequencies within the usable bandwidth that can extend up to around 12 GHz. Additional antennas can also be provided, for example, to cover VHF and UHF frequencies as well as iridium-based antennas for covering a range (e.g., up to 6 GHz) frequencies used by shipboard radar emitters.

According to one embodiment, an antenna module configured to couple with the hull of an underwater vehicle includes a housing and a mechanical coupler that connects the housing to the hull of the underwater vehicle. The housing encloses a plurality of components that include a substrate and one or more spiral antennas on the substrate. The substrate includes at least a first plane and a second plane opposite the first plane. Each of the one or more spiral antennas includes a first spiral trace pattern on the first plane and a second spiral trace pattern on the second plane. The first spiral trace pattern is coupled to the second spiral trace pattern with vias through a thickness of the substrate. The housing is configured to rotate, via the mechanical coupler, between a deployed position extending away from the hull of the underwater vehicle and a stowed position against the hull or closer to the hull compared to the deployed position. In some embodiments, the housing is curved such that it closely contours around the similarly curved hull of the underwater vehicle. In some embodiments, the substrate and/or the housing is flexible allowing it to bend around the curved hull of the underwater vehicle when in the stowed position.

According to another embodiment, an RF system configured for use on an underwater vehicle includes an antenna module configured to receive an RF signal, front end circuitry configured to receive the RF signal from the antenna module and down-convert that RF signal to a lower frequency signal, at least one analog to digital converter (ADC) configured to transform the resulting analog signal into a digital signal, and a processor configured to receive the digital signal and execute one or more operations based on the digital signal. Alternatively, or in addition, the processor may be configured to generate a digital signal for transmission, and at least one digital to analog converter (DAC) configured to transform the digital signal to an analog signal, and the front end circuitry may be configured up-convert that analog signal into an RF signal that is passed to and transmitted by the antenna module. Other functions typical of a receiver or transmitter (or transceiver, as the case may be), such as filtering and amplification performed in the front end circuitry, may be carried out as well, as will be appreciated. The antenna module includes a housing and a mechanical coupler that connects the housing to a hull of the underwater vehicle. The housing encloses a plurality of components that include a substrate and one or more spiral antennas on the substrate. The substrate includes at least a first plane and a second plane opposite the first plane. Each of the one or more spiral antennas includes a first spiral trace pattern on the first plane and a second spiral trace pattern on the second plane. The first spiral trace pattern is coupled to the second spiral trace pattern with vias through a thickness of the substrate. The housing is configured to rotate, via the mechanical coupler, between a deployed position extending away from the hull of the underwater vehicle and a stowed position against the hull or closer to the hull compared to the deployed position.

Numerous embodiments, variations, and applications will be appreciated in light of the disclosure herein. The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. When used to describe a range of dimensions, the phrase "between X and Y" represents a range that includes X and Y. Note the reference to undersea and underwater herein are used interchangeably, and the present disclosure is not intended to be limited to sea water.

Example Signaling Environment

FIG. 1 illustrates an example maritime environment 100 in which an undersea vehicle 104 moves beneath the water's surface 102. Undersea vehicle 104 may be any kind of submerged vehicle or platform, such as an unmanned undersea vehicle (UUV), although manned undersea vehicles can equally benefit as well. As further illustrated in FIG. 1, undersea vehicle 104 may approach the water's surface 102 and extend an antenna module 106 housing one or more different types of antennas, according to an embodiment of the present disclosure. The different types of antennas may be planar antennas provided on an antenna substrate and can include spiral antennas (providing wideband DF capability), one or more GPS antennas, one or more UHF/VHF antennas, or one or more iridium-based RF antennas.

In some embodiments, antenna module 106 is used by undersea vehicle 104 to send/receive wireless communication signals 108 with, for example, a ship, aircraft, satellite, other undersea vehicle, or a land-based communication station. Data received by undersea vehicle 104 may include, for example, GPS signals to geolocate the undersea vehicle, intended and/or intercepted messages/communications, or signals to program a processing device onboard undersea vehicle 104. Data transmitted by undersea vehicle 104 may include, for example, messages/communications, or data gathered from any sensors onboard undersea vehicle 104. In some embodiments, undersea vehicle 104 and/or any part of antenna module 106 includes one or more other sensors, such as a camera to capture above-surface images, a radiation sensor to detect the presence of above-surface radiation, a temperature sensor to detect the above-surface temperature, and/or a contact sensor or range-finder to detect the above-surface objects. In a more general sense, any type of sensor or antenna type may be provided that can assist in communicating information to undersea vehicle 104 or from undersea vehicle 104, as will be appreciated.

Example embodiments provided herein describe how antenna module 106 can be safely stowed against or close to the hull of undersea vehicle 104 when not in use and extended away from undersea vehicle 104 (as illustrated) when needed to send/receive RF signals from above the water's surface 102. In some examples, the curved design and/or flexible material used for antenna module 106 allows for it to lie closely contoured with a similar curved surface of the hull of undersea vehicle 104 when it is in its stowed state.

Example RF system

Figure 2:
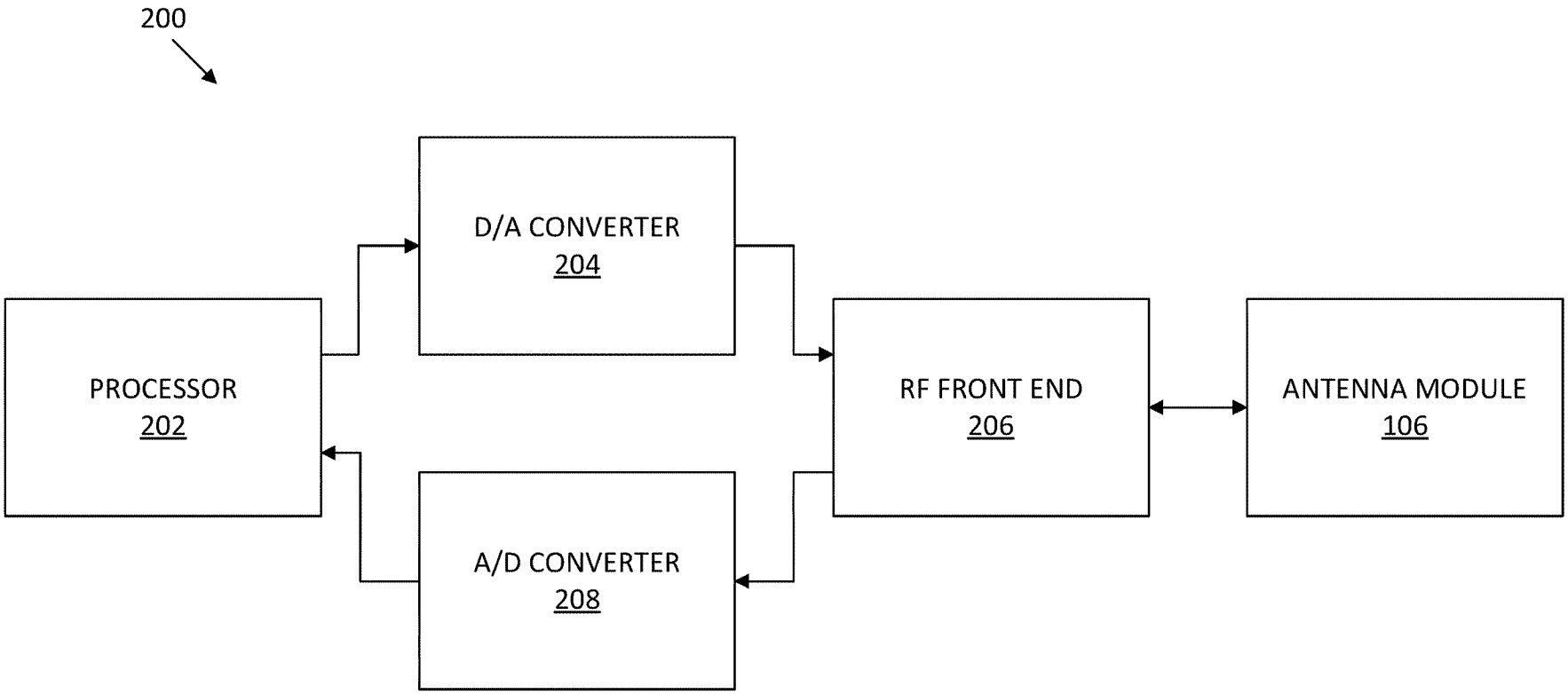
FIG. 2 illustrates an example RF system, in accordance with some embodiments of the present disclosure.

FIG. 2 illustrates an example RF system 200 that can be used on board underwater vehicle 104 to transmit and/or receive RF radiation. RF system 200 includes a processor 202, a digital-to-analog converter (DAC) 204, RF front end circuitry 206, an analog-to-digital converter (ADC) 208, and antenna module 106. In some cases, any of processor 202, DAC 204, RF front end circuitry 206, or ADC 208 is implanted as a system-on-chip, or a chip set populated on a printed circuit board (PCB) which may in turn be populated into a chassis of a multi-chassis system or an otherwise higher-level system, although any number of implementations can be used. RF system 200 may be one portion of an electronic device on board underwater vehicle 104 that sends and/or receives RF signals.

Processor 202 may be configured to generate and/or receive digital signals to be used for communication, guidance, or surveillance purposes. As used herein, the term "processor" may refer to any device or portion of a device that processes electronic data from registers and/or memory to transform that electronic data into other electronic data that may be stored in registers and/or memory. Processor 202 may include one or more digital signal processors (DSPs), application-specific integrated circuits (ASICs), central processing units (CPUs), custom-built semiconductor, or any other suitable processing devices that can create digital signals for transmission via the antenna module 106 and/or process received messages received via the antenna module 106. The present disclosure is not intended to be limited to any particular processor configuration, or more generally, to any particular receiver architecture or transmitter architecture.

Rather, the antenna module 106 provided herein can be used with any number of communication systems, as will be appreciated.

DAC 204 may be implemented to receive a digital signal from processor 202 and convert the signal into an analog signal that can be subsequently processed via RF front end 206 and transmitted via antenna module 106. DAC 204 may be any known type of DAC without limitation. In some embodiments, DAC 204 has a linear range of between about 6 GHz and about 10 GHz, and the input resolution is in the range of 6 to 12 bits, although the present disclosure is not intended to be limited to such specific implementation details.

RF front end circuitry 206 may include various components that are designed to filter, amplify, and tune selected portions of a received analog signal, according to an embodiment. RF front end circuitry may be designed to have a high dynamic range that can tune across a wide bandwidth of frequencies. For example, RF front end circuitry 206 may include components that are capable of tuning to particular frequency ranges within a signal having a bandwidth in the gigahertz range, such as bandwidths between 5 GHz and 50 GHz. In some embodiments, RF front end circuitry 206 up-converts the received AC signal from DAC 204 to an RF signal and then modulates that RF signal onto a carrier signal. In some embodiments, RF front end circuitry 206 receives an analog signal from antenna module 106 and performs one or more of demodulation, down-converting, filtering, or amplification of the received signal. In some embodiments, RF front end circuitry 206 includes one or more integrated circuit (IC) chips packaged together in a system-in-package (SIP). Again, any number of RF front end architectures can be used here.

ADC 208 may be implemented to receive an analog signal from RF front end circuitry 206 and convert the signal into a digital signal that can be received by processor 202 for further analysis. ADC 208 may be any known type of ADC without limitation. In some embodiments, ADC 208 has a linear range of between about 6 GHz and about 10 GHz, and the input resolution is in the range of 6 to 12 bits, although the present disclosure is not intended to be limited to such specific implementation details.

Antenna module 106 may receive RF signals from RF front end circuitry 206 and transmit the signals out and away from underwater vehicle 104, according to some embodiments. In some embodiments, antenna module 106 receives RF radiation impinging upon the various antennas within antenna module 106 and passes the resulting RF signal to the RF front end 206, which then converts the received RF signal to an analog signal that is received by RF front end circuitry 206. As will be described in more detail herein, antenna module 106 includes an array of spiral antennas that allow for both wide bandwidth operation and DF capability. These features allow antenna module 106 to transmit and/or receive a wide bandwidth of communication frequencies from any direction and determine the general direction from which the signals were received.

Antenna Module Design

Figure 3B:
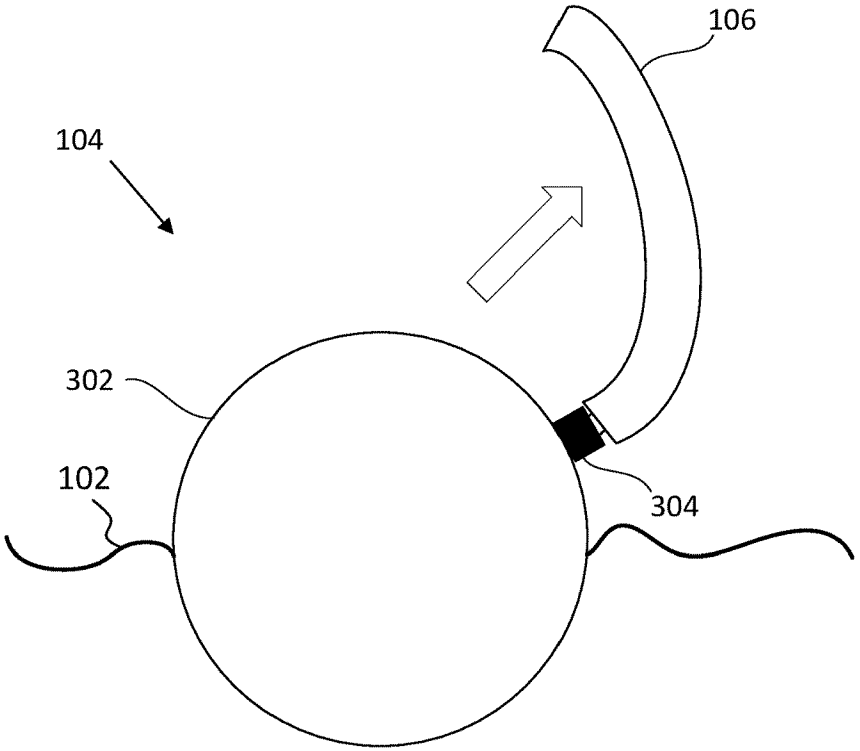
FIGS. 3A and 3B illustrate an antenna structure coupled to the outside of an undersea vehicle in a stowed position and in an extended position, respectively, in accordance with some embodiments of the present disclosure.
Figure 3A:
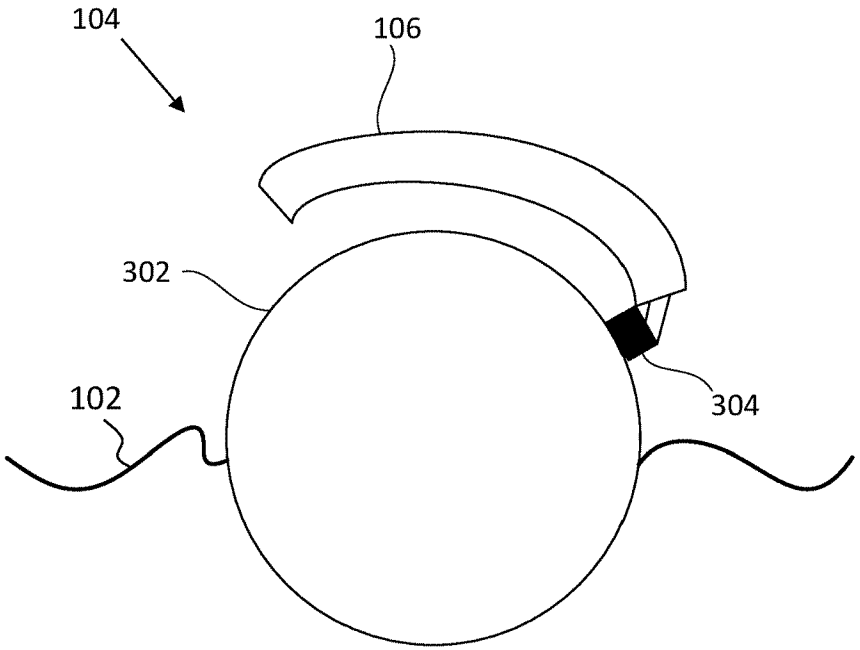

FIGS. 3A and 3B illustrate cross-section views taken across a hull 302 of undersea vehicle 104 that has antenna module 106 mechanically coupled to hull 302. According to some embodiments, underwater vehicle 302 has a substantially circular cross-section owing to its generally cylindrical shape. Underwater vehicle 104 may have a circular cross-section with a diameter between, for example, about 9 inches and 16 inches. In other embodiments, the hull 302 of underwater vehicle 104 may have other curved shapes suitable for an underwater vehicle, such as elliptical, ovoid, etc. Note that FIGS. 3A and 3B are not drawn to scale, and are instead drawn to show functionality of the antenna module 106. In actuality, the antenna module 106 can stow in a relatively flush fashion against the outer surface of the hull 302. In another example antenna module 106 can be recessed into a region of the hull when in its stowed position. Further details of the antenna module are shown in FIGS. 4-7B.

As seen in FIG. 3A, underwater vehicle 104 has surfaced above the water's surface 102 such that a portion of underwater vehicle 104 that includes antenna module 106 is exposed above the waterline 102. A further example maintains the underwater vehicle 104 at or slightly below the water's surface 102 so that only the antenna module 106 is above the water's surface 102. Antenna module 106 is in a stowed position either against or close to hull 302 during normal operations. Antenna module 106 may have a curved shape with a radius of curvature similar to that of hull 302, such that antenna module 106 closely contours with hull 302 when in its stowed position. In one example, hull 302 has a recessed region accommodating the size of the antenna module 106 and the antenna module 106 rests within the recessed portion to provide a smooth profile that limits noise and drag. According to some embodiments, antenna module 106 is kept in its stowed position during movement of undersea vehicle 104 to lessen any drag caused by antenna module 106. In some embodiments, antenna module 106 is kept in its stowed position during any period of time that it is not actively sending RF signals or attempting to intercept RF signals. Antenna module 106 is coupled to hull 302 via a coupling mechanism 304. According to some embodiments, coupling mechanism 304 can be any type of hinged mechanical structure or rotatable mechanical joint that allows antenna module 106 to rotate between a stowed position (as illustrated in FIG. 3A) and a deployed position (as illustrated in FIG. 3B). One or more servos, such as one or more stepper motors, can be used to actuate the rotation of antenna module 106 to any position between its fully stowed state and fully deployed state.

FIG. 3B illustrates antenna module 106 rotated outwards to its fully deployed state, according to some embodiments. In its deployed state, antenna module 106 extends away from hull 302 in a circumferential deployment and provides more clear access (e.g., away from sources, such as the water or hull, that would attenuate the RF signals) for the various antennas on antenna module 106 to send and/or receive RF signals. The curved length of the antenna module 106 is dependent upon the width dimensions of the hull 302 and the extent to which the antenna module 106 extends about the circumference around the hull 302. In one example the antenna module extends less than half of the circumference around the hull or less than ¼ of the circumference around the hull.

Figure 4:
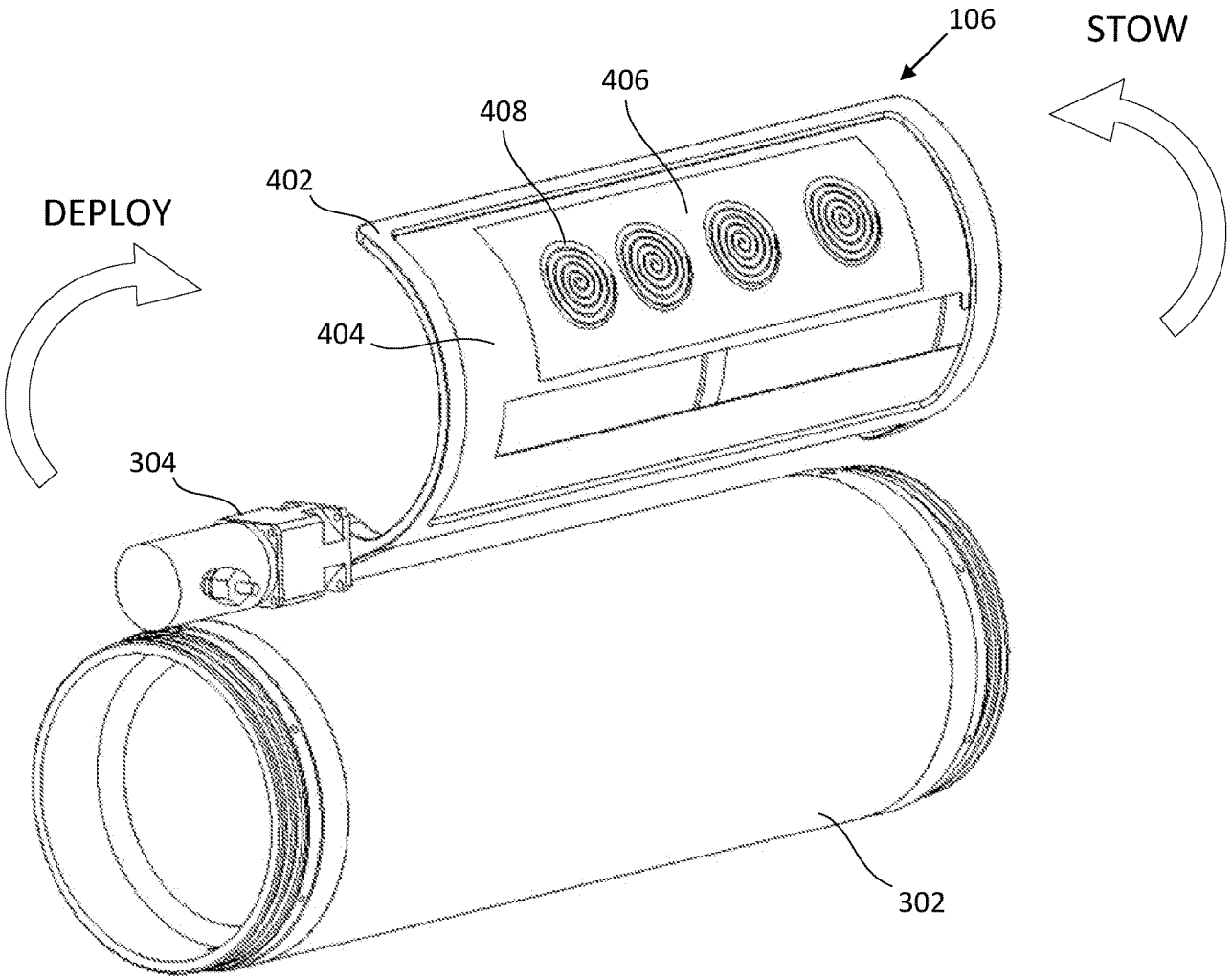
FIG. 4 illustrates a perspective view of a curved antenna structure coupled to the outside of an undersea vehicle, in accordance with an embodiment of the present disclosure.

FIG. 4 illustrates a perspective view of antenna module 106 after it has been rotated in a clockwise direction (relative to current perspective view) into its deployed state away from hull 302 of underwater vehicle 104. In its stowed state, the curvature of antenna module 106 can be substantially flush against the curvature of hull 302, such that very little drag would be caused by the antenna module 106, other than the coupling mechanism 304 that extends outward of the hull 302 surface. In other embodiments, note that coupling mechanism 304 can be partially or completely recessed into a void in the hull 302 so as to further improve the drag free nature of the antenna system. Likewise, the portion of the hull 302 where the antenna module 106 stows against can be machined or otherwise formed with a complementary recess configured to receive the stowed the antenna module 106, to even further improve the drag free nature of the antenna system.

The coupling mechanism 304 in one example includes a waterproof connection to the interior of the hull 302 to enable wires from the electronics and processing elements in the interior of the hull 302 to provide power and communications with the antenna module 106. The waterproof connection may be creating using connectors on both hull 302 and antenna module 106 with seals on the outer jackets of the cables with compression fittings, gaskets, o-rings, potting compound, etc. These seals can exist as integrated features of hull 302 and antenna module 106 or they can be separate parts which are attached to one or more cables and then sealed to the hull 302 and antenna module 106 (with an o-ring, gasket, etc.) In another embodiment, glass-to-metal sealed connectors are provided on the boundary between hull 302 and antenna module 106. In some other embodiments, hull 302, coupling mechanism 304, and antenna module 106 are all formed as a single pressurized vessel allowing wires or cables to pass through the components without any additional waterproofing.

According to some embodiments, antenna module 106 has a housing 402 that encloses an insulating material 404, an antenna substrate 406, and a plurality of spiral antennas 408 on antenna substrate 406. Various layers of antenna module 106 are stripped away in the figure to view different components within housing 402. More details regarding the design of spiral antennas 408 and any other antennas on antenna substrate 406 are provided with reference to FIGS. 5A-5C.

Housing 402 may be, for example, a radome structure that is designed to protect all the interior components of antenna module 106 from the environment (e.g., leak proof) while providing little attenuation to RF signals sent or received by any antennas on substrate 406. In some embodiments, housing 402 is any fiber-reinforced polymer composite material or epoxy-based matrix.

According to some embodiments, the interior of antenna module 106 includes insulating material 404 that also partially covers or surrounds substrate 406. Insulating material 404 may be any type of syntactic foam and is generally selected to provide little or no attenuation to RF signals sent or received by any antennas on substrate 406. For example, insulating material 404 includes any low-k dielectric material.

As noted previously, substrate 406 can represent a single substrate (having only a frontside and backside to provide two different metallization layers) or a multi-layer substrate having any number of layers to provide more than two different metallization layers. According to some embodiments, substrate 406 includes two layers bonded together to provide three different metallization layers (e.g., one on the frontside, one in the middle, and one on the backside).

According to some embodiments, substrate 406 is flexible such that it can bend within the curved shape defined by housing 402. As noted above, the curvature of antenna module 106 may be similar to the curvature of hull 302 to allow antenna module 106 to rest against or near hull 302 in a contoured fashion when antenna module 106 is rotated into its stowed state via coupling mechanism 304. Again, the antenna module 106 can be seated in a recess provisioned on the outer surface of hull 302 and complementary to a thickness of the antenna module 106, in some embodiments. According to some embodiments, antenna module 106 does not include a rigid housing 402. In such cases, substrate 406 (and possibly also insulating material 404 or other flexible layers of antenna module 106) is shaped or otherwise biased to flex around the curvature of hull 302 when in the stowed state.

Figure 5A:
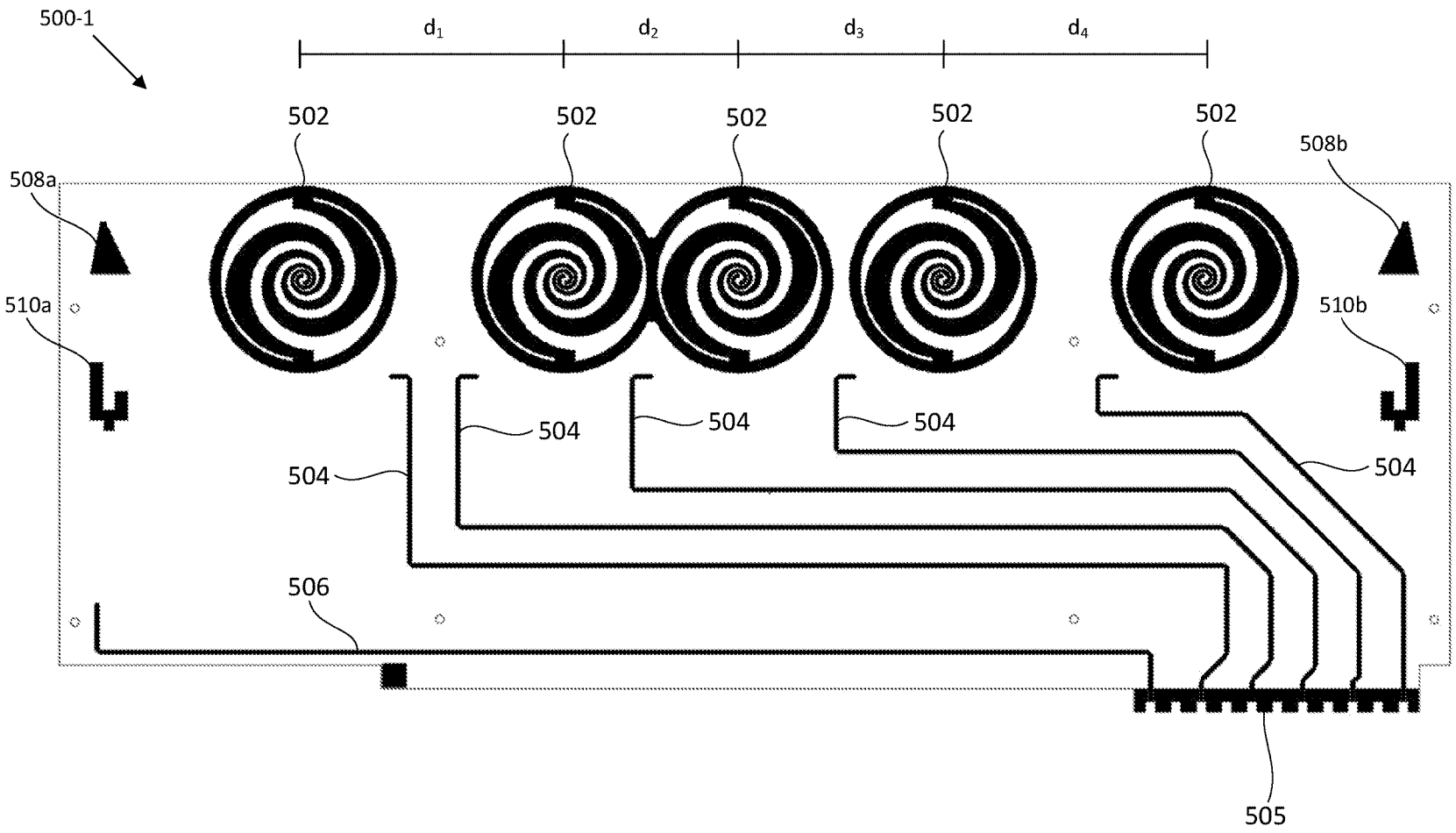
FIGS. 5A-5C illustrate different metal patterns on different substrate levels of an antenna substrate, in accordance with some embodiments of the present disclosure.
Figure 5B:
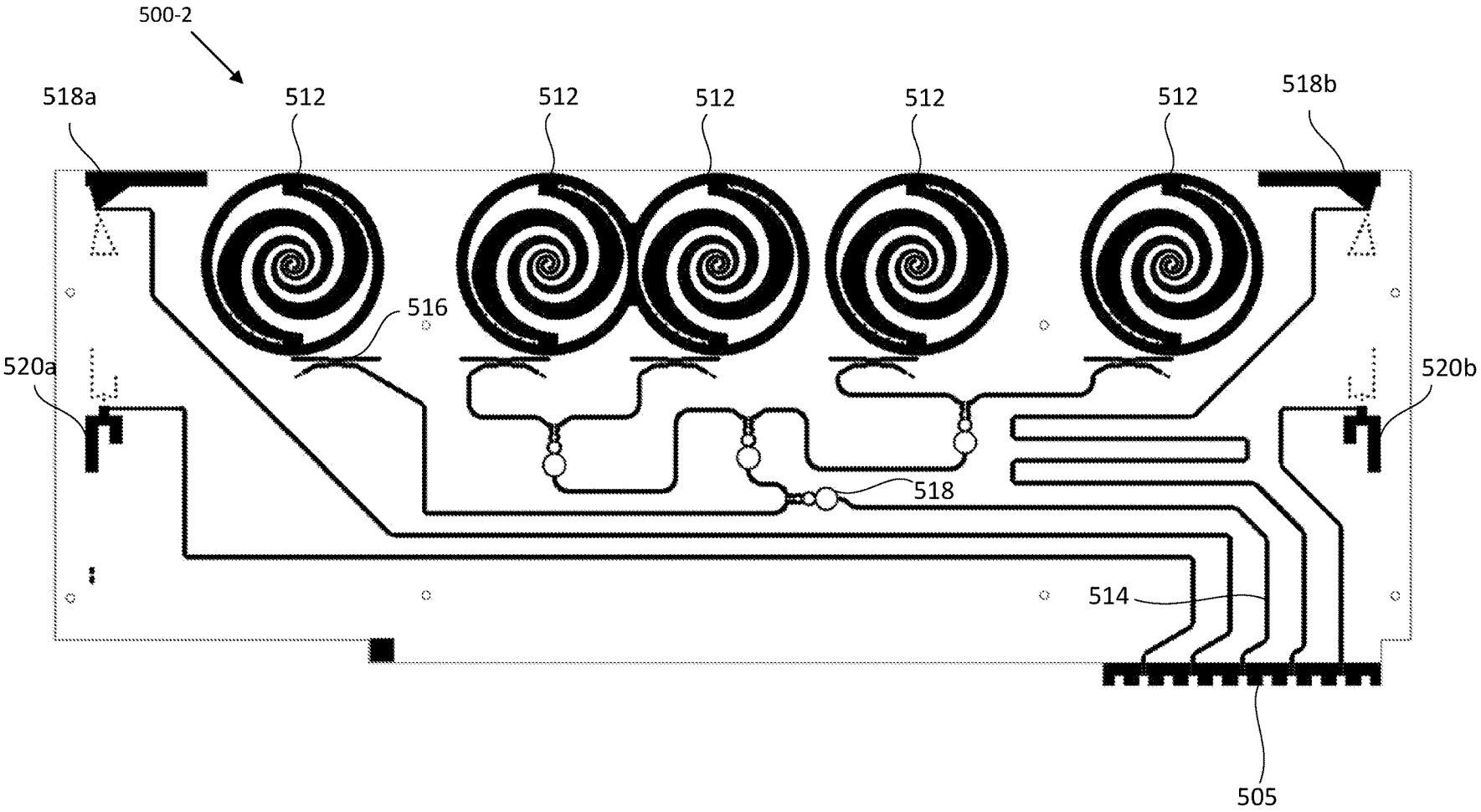
Figure 5C:
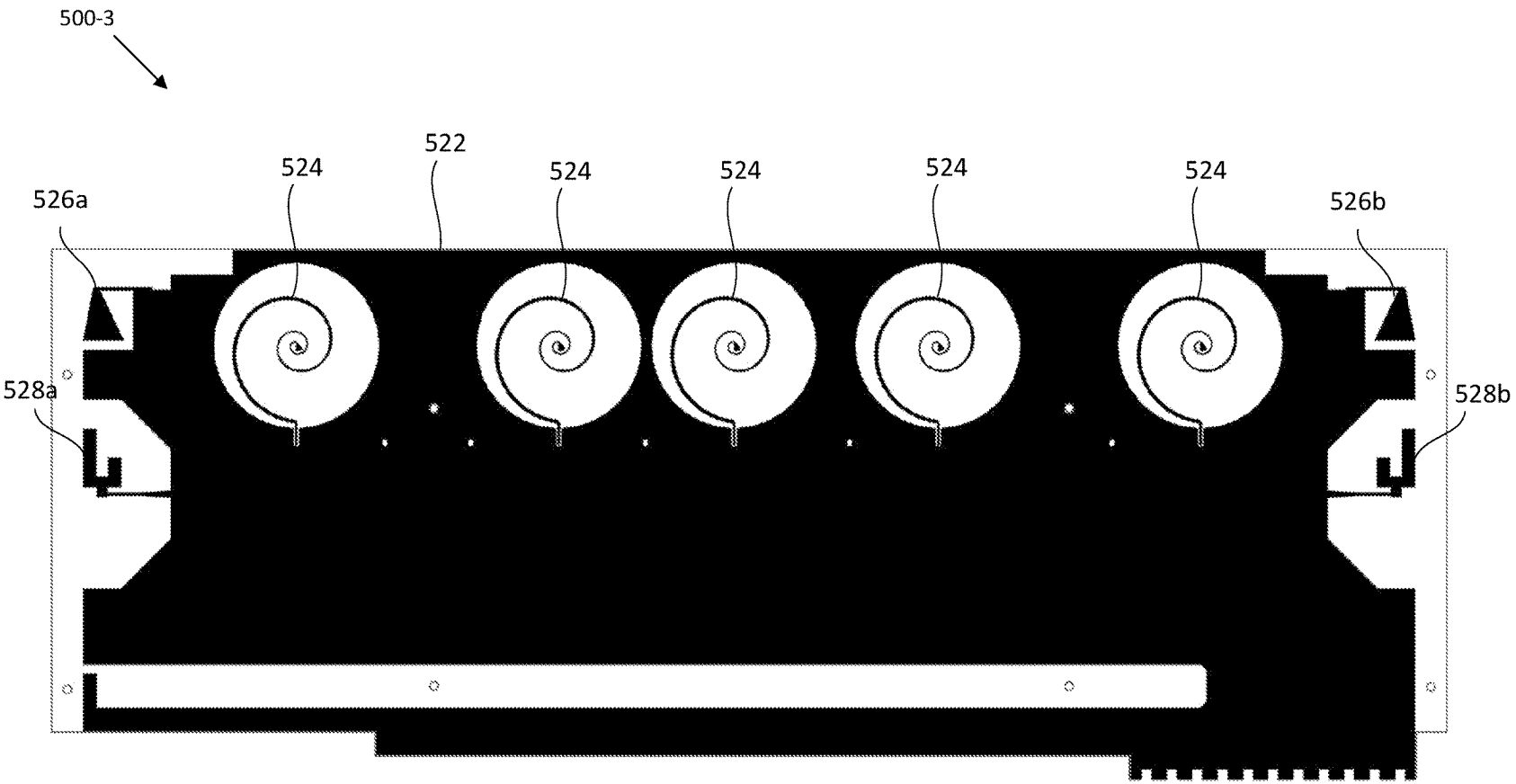

FIGS. 5A-5C illustrate layout patterns for different metallization layers on substrate 406, according to some embodiments. In the illustrated example, substrate 406 includes three metallization layers with a first metallization layer 500-1 present on a first plane of the substrate (e.g., a frontside surface of the substrate), a second metallization layer 500-2 present on a second plane of the substrate (e.g., a backside surface of the substrate), and a third metallization layer 500-3 present on third plane of the substrate parallel to and between the first and second planes (e.g., through a middle portion of the substrate). The various trace widths and feature sizes may not be drawn to scale and thus should not be used to limit the scope of the antenna design. Additionally, some patterns or traces may be present on different metal layers than those illustrated. The metal patterns that define the various traces and antenna structures may be formed from copper or any other conductive material, such as gold or platinum using standard lithographic techniques. According to some embodiments, each of first metallization layer 500-1, second metallization layer 500-2, and third metallization layer 500-3 are aligned over one another in a stacked configuration on different planes of substrate 406.

FIG. 5A illustrates a top-down view of first metallization layer 500-1 that includes portions of a plurality of spiral antennas 408 and portions of other antenna types. According to some embodiments, a linear array of microstrip spiral patterns 502 is formed. Each of the spiral patterns 502 represents one layer of its corresponding spiral antenna. Spiral patterns 502 may be arranged with different gaps between adjacent ones of the spiral patterns across the linear array. For example, as noted in FIG. 5A, a first spiral pattern may be separated from a second spiral pattern by a distance $d_1$ between the center points of the first and second spiral patterns. A third spiral pattern may be directly adjacent to the second spiral pattern such that a distance $d_2$ is between the center points of the second and third spiral patterns. A fourth spiral pattern may be separated from the third spiral pattern such that a distance $d_3$ is between the center points of the third and fourth spiral patterns, and a fifth spiral pattern is separated from the fourth spiral pattern such that a distance $d_4$ is between the center points of the fifth and fourth spiral patterns. The ratios between the various distances between spiral antennas may be chosen to provide a wide bandwidth of usable frequencies that reduces ambiguity between received RF signals. In some examples, distances $d_1$ and $d_4$ are approximately the same and may be between 4.0 inches and 4.25 inches, while distance $d_2$ may be between 2.5 inches and 3.0 inches, and distance $d_3$ may be between 3.0 inches and 3.5 inches.

Each of the spiral antennas is feed with its own signal trace 504. Accordingly, each signal trace 504 carries signals to be transmitted from its corresponding spiral antenna or carries signals received from its corresponding spiral antenna. According to some embodiments, each of signal traces 504 leads from a corresponding spiral antenna to an edge connector 505 located along one edge of the substrate. Edge connector 505 may be used to electrically couple various metal signal lines to one or more cables (e.g., coaxial cables, ribbon cables, etc.) that carry signals between antenna module 106 and circuitry within undersea vehicle 104. According to some embodiments, edge connector 505 is aligned with a portion of antenna module 106 that couples with mechanical coupler 304, such that cables connecting to edge connector 505 are provided within mechanical coupler 304. A ground trace 506 may be provided to couple with a ground plane located on a different metallization layer, such as on third metallization layer 500-3.

According to some embodiments, the substrate includes other types of antennas beyond the linear array of spiral antennas. For example, first metallization layer 500-1 may include portions of GPS antennas, identified as GPS structure 508*a* and GPS structure 508*b*. In some embodiments, first metallization layer 500-1 includes portions of iridium antennas, identified as iridium structure 510*a* and iridium structure 510*b*.

FIG. 5B illustrates a top-down view of second metallization layer 500-2 that includes portions of a plurality of spiral antennas 408 and portions of other antenna types. According to some embodiments, a linear array of microstrip spiral patterns 512 is formed that align with the linear array of microstrip spiral patterns 502 on first metallization layer 500-1. Each of the spiral patterns 512 represents one layer of its corresponding spiral antenna. Accordingly, spiral patterns 512 are arranged with the same gap pattern used for the linear array of microstrip spiral patterns 502. According to some embodiments, each spiral pattern 512 on second metallization layer 500-2 is connected to its corresponding spiral pattern 502 on first metallization layer 500-1 using any number of metal vias through a thickness of substrate 406. A given spiral pattern 512 with its corresponding spiral pattern 502, connected using metal vias, are elements of a single spiral antenna.

According to some embodiments, a reference signal is provided to each of the spiral antennas through a reference signal trace 514. According to some embodiments, reference signal trace 514 is split using a series of 2×1 splitters 518 and terminating at respective 2×2 couplers 516 at each spiral antenna. The various split branches of reference signal trace 514 are received at one input of each 2×2 coupler 516 while a corresponding signal trace 504 is received at the other input of each 2×2 coupler 514. Each 2×2 coupler 516 has a first output that terminates with a dead end and a second output that connects to an I/O trace coupled to its corresponding spiral antenna. The I/O trace may be provided on a different metallization layer (such as on third metallization layer 500-3). According to some embodiments, a reference signal is provided on reference signal trace 514 to compensate for the different length paths used by signal traces 504 leading to each spiral antenna. The compensation may be performed by identifying phase differences between the signals received from the different spiral antennas.

According to some embodiments, second metallization layer 500-2 includes portions of GPS antennas, identified as GPS structure 518*a* and GPS structure 518*b*. In some embodiments, second metallization layer 500-2 includes portions of iridium antennas, identified as iridium structure 520*a* and iridium structure 520*b*. The signal traces for providing signals to/from the various GPS and iridium antennas can also be provided on second metallization layer 500-2. The signal traces run between their corresponding antenna structures and edge connector 505.

FIG. 5C illustrates a top-down view of third metallization layer 500-3 that includes portions of a plurality of spiral antennas 408 and portions of other antenna types. According to some embodiments, microstrip spiral I/O traces 524 are provided on third metallization layer 500-3 for each of the spiral antennas. One end of each I/O trace 524 connects to the output of its corresponding 2×2 coupler 516 and the other end of each I/O trace 524 connects to one or both of its corresponding spiral pattern 502 on first metallization layer 500-1 and spiral pattern 512 on second metallization layer 500-2. According to some embodiments, each I/O trace 524 connects to one or both spiral patterns at the central point of the one or both spiral patterns. According to some embodiments, each I/O trace 524 follows the same spiral pattern as one or both of spiral pattern 502 and spiral pattern 512.

According to some embodiments, third metallization layer 500-3 includes a ground plane 522 that encompasses a majority of the available footprint. Ground plane 522 may be coupled to ground trace 506 on first metallization layer 500-1. According to some embodiments, ground plane 522 acts as its own antenna. For example, ground plane 522 may be used as a folded over monopole antenna to provide low-band UHF/VHF frequencies.

According to some embodiments, third metallization layer 500-3 includes portions of GPS antennas, identified as GPS structure 526*a* and GPS structure 526*b*. In some embodiments, third metallization layer 500-3 includes portions of iridium antennas, identified as iridium structure 528*a* and iridium structure 528*b*.

Figure 6:
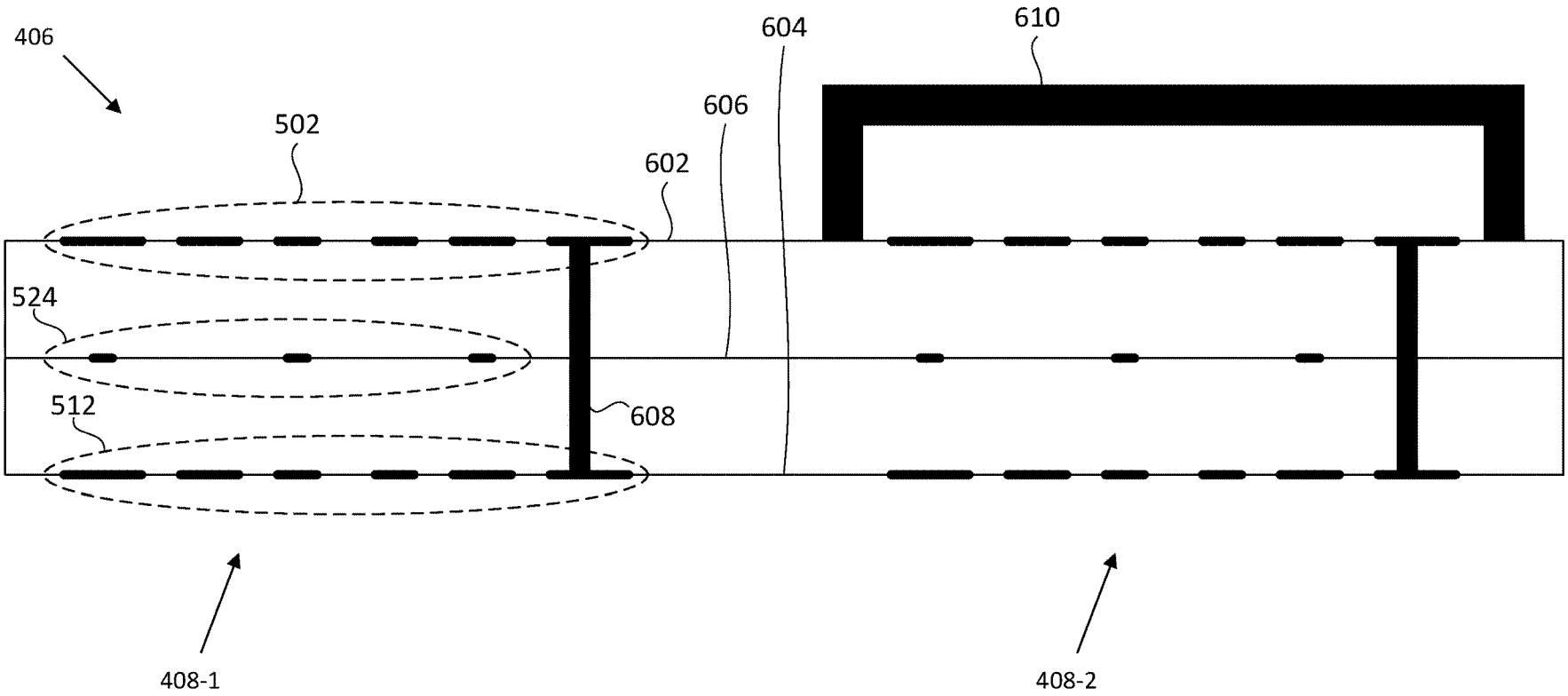
FIG. 6 illustrates a cross-section view through the antenna substrate of FIGS. 5A-5C, in accordance with some embodiments of the present disclosure.

FIG. 6 illustrates a cross-section view taken through substrate 406, according to some embodiments. Two spiral antennas 408-1 and 408-2 are illustrated having the various metal patterns of each spiral antenna on different planes of substrate 406. For example, spiral pattern 502 is a part of the first metallization pattern on a first plane 602 of substrate 406, spiral pattern 512 is a part of the second metallization pattern on a second plane 604 of substrate 406, and I/O trace 524 is a part of the third metallization pattern on a third plane 606 of substrate 406. As noted above, one or more conductive vias 608 through a thickness of substrate 406 are used to electrically connect spiral pattern 502 with spiral pattern 512 for a given spiral antenna.

According to some embodiments, one or more of the spiral antennas (such as spiral antenna 408-2) provided on substrate 406 has half of the antenna covered using an RF attenuating structure 610. RF signals cannot penetrate through RF attenuating structure 610 (or are substantially reduced by RF attenuating structure 610). According to some embodiments, RF attenuating structure 610 includes any conductive material that is grounded (e.g., with ground plane 522). According to some embodiments, RF attenuating structure 610 is designed to have a cavity depth between about ¼ wavelength and ½ wavelength of the RF frequencies of interest. Accordingly, spiral antenna 408-2 acts as a directional antenna that can be used to determine whether RF signals are initially impinging upon first plane 602 or second plane 604.

Figure 7A:
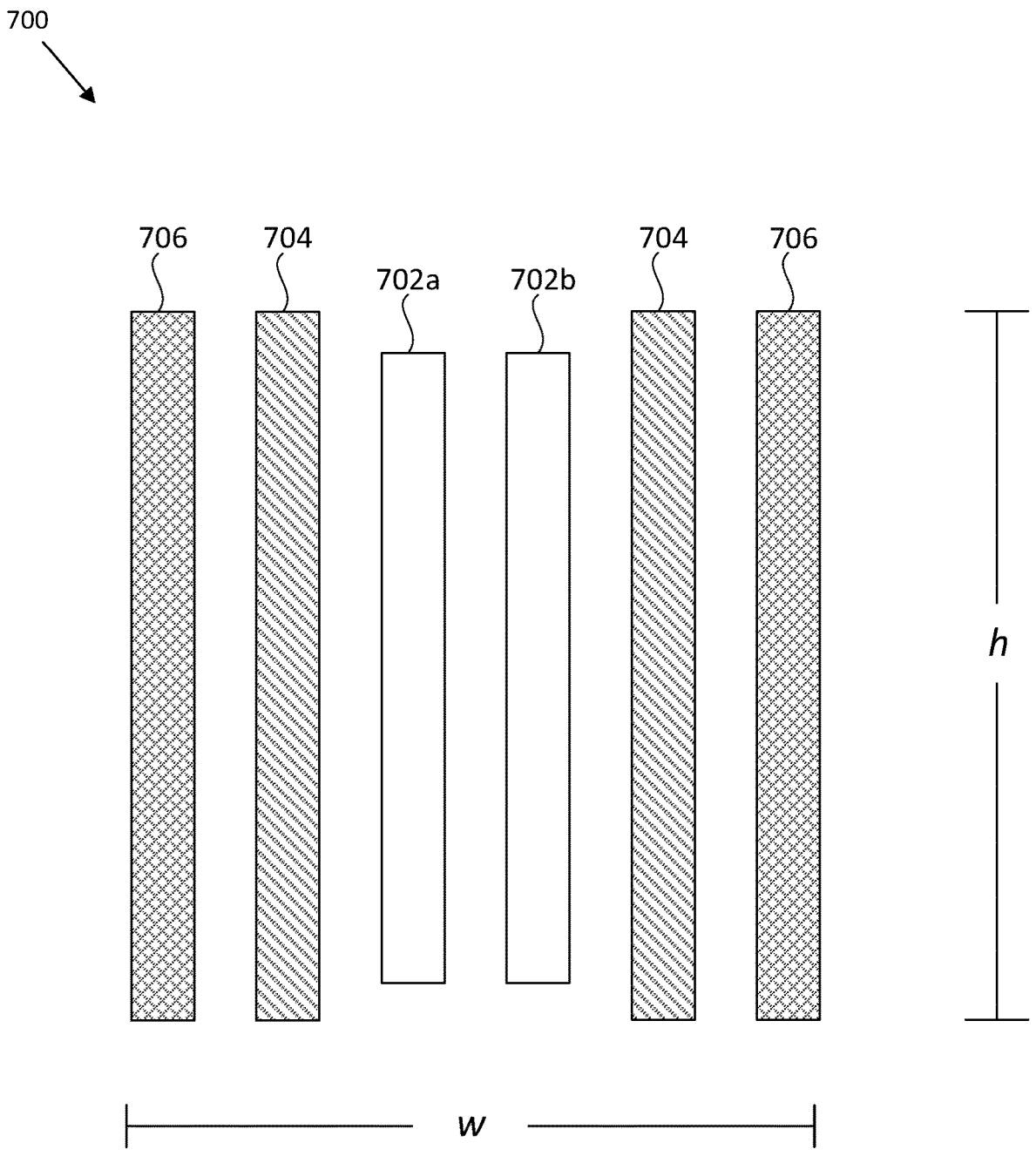
FIGS. 7A and 7B illustrate cross-section views of antenna structures that have a different number of stacked substrates, in accordance with some embodiments of the present disclosure.
Figure 7B:
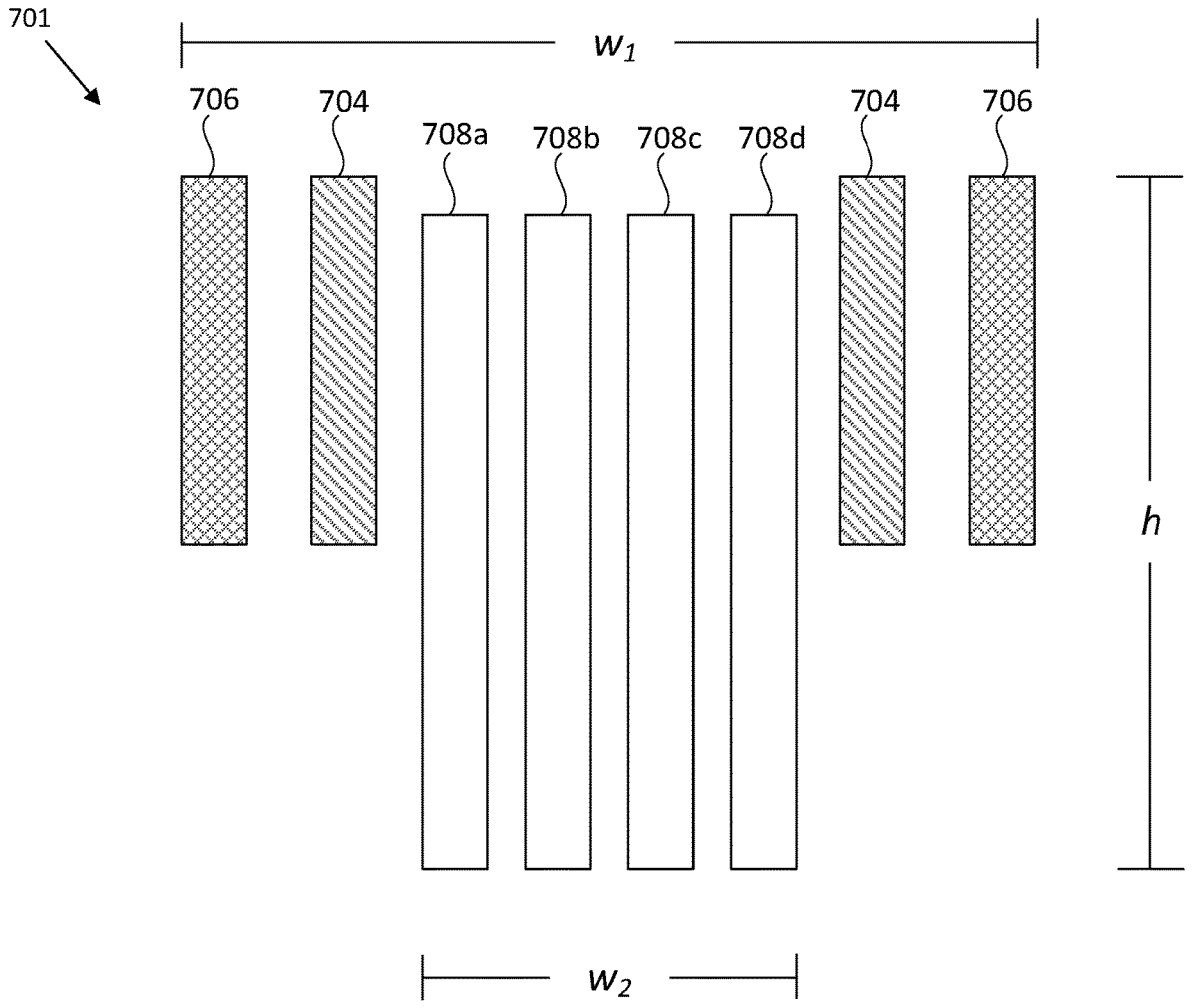

FIGS. 7A and 7B illustrate different layer structures for antenna module 106 that include antenna substrate layers and protective layers over the antenna substrate layers. The exact dimensions and thicknesses of the various layers are not drawn to scale, and the sizes are used for illustrative purposes only.

FIG. 7A illustrates an antenna module layer structure 700 that includes two substrate layers 702*a* and 702*b* stacked together along with insulating material 704 and housing 706. Each of substrate layers 702*a* and 702*b* can be a printed circuit board (PCB) material such as an RO5880LZ board with a thickness around 0.5 mm each. According to some embodiments, each of substrate layers 702*a* and 702*b* is flexible such that the antenna substrate can bend within the generally curved shape of antenna module 106, as illustrated, for example, in FIG. 4. By using two stacked substrate layers, antenna structures and/or ground layers can be formed across three different metallization layers (e.g., first plane on front-side of the substrate, second plane in the middle of the substrate, and third plane on the back-side of the substrate). According to some embodiments, antenna module layer structure 700 has a width (w) between about 8 mm and about 12 mm and a height (h) between about 215 mm and about 245 mm. In one example the leading edge of the antenna module 106 represents the forward portion and can include a tapered leading edge that further reduces the noise and drag when the underwater vehicle 104 is traveling through the water. The hinge portion 304 in one example also has a smooth profile which may include a cover that facilitates a smooth profile.

Insulating material 704 is provided over substrate layers 702*a* and 702*b*. In some embodiments, insulating material 704 completely surrounds the stack of substrate layers 702*a* and 702*b*, while in other embodiments, insulating material 704 covers at least the front-side and back-side of the stack of substrate layers 702*a* and 702*b*. Insulating material 704 can be any low-k dielectric material. For example, insulating material 704 is a syntactic foam with a thickness between about 2.5 mm and about 5.0 mm. According to some embodiments, one or more cables run through insulating material 704 to be coupled to edge connector 505 on the antenna substrate.

Housing 706 may be designed to encase the other components of antenna module layer structure 700 and protect them from the environment. Accordingly, housing 706 may include a leak-proof material to protect the antenna components from any surrounding water. Housing 706 may include any fiber-reinforced polymer composite material (e.g., E-glass) or epoxy-based matrix. According to some embodiments, housing 706 has a thickness between about 0.5 mm and about 1.5 mm.

FIG. 7B illustrates an antenna module layer structure 701 that includes four substrate layers 708*a*-708*d* stacked together along with insulating material 704 and housing 706. Each of substrate layers 708*a*-708*d* can be a PCB material such as an RO5880LZ board with a thickness around 0.5 mm each. According to some embodiments, each of substrate layers 708*a*-708*d* is flexible such that the antenna substrate can bend within the generally curved shape of antenna module 106, as illustrated, for example, in FIG. 4. By using four stacked substrate layers, antenna structures and/or ground layers can be formed across five different metallization layers (e.g., first plane on front-side of the substrate, second, third, and fourth planes in the middle of the substrate, and fifth plane on the back-side of the substrate). According to some embodiments, antenna structures and/or ground planes are formed only on the middle three planes (e.g., between substrate layers 708*a* and 708*b*, between substrates layers 708*b* and 708*c*, and between substrate layers 708*c* and 708*d*) that are protected by the outer substrate layers 708*a* and 708*d*. By using substrate layers 708*a* and 708*d* as protective layers, insulating material 704 and housing 706 can be made smaller such that they do not need to surround the entire antenna substrate. According to some embodiments, antenna module layer structure 701 has a total width ($w_1$) between about 8 mm and about 12 mm and a second width ($w_2$) of the antenna substrate made up of substrate layers 708*a*-708*d* between about 1.75 mm and about 2.25 mm. The height (h) of antenna module layer structure 701 may be between about 215 mm and about 245 mm. Both insulating material 704 and housing 706 on antenna module layer structure 701 may have the same general properties as discussed above for antenna module layer structure 700.

Example Undersea Vehicle Componentry

Figure 8:
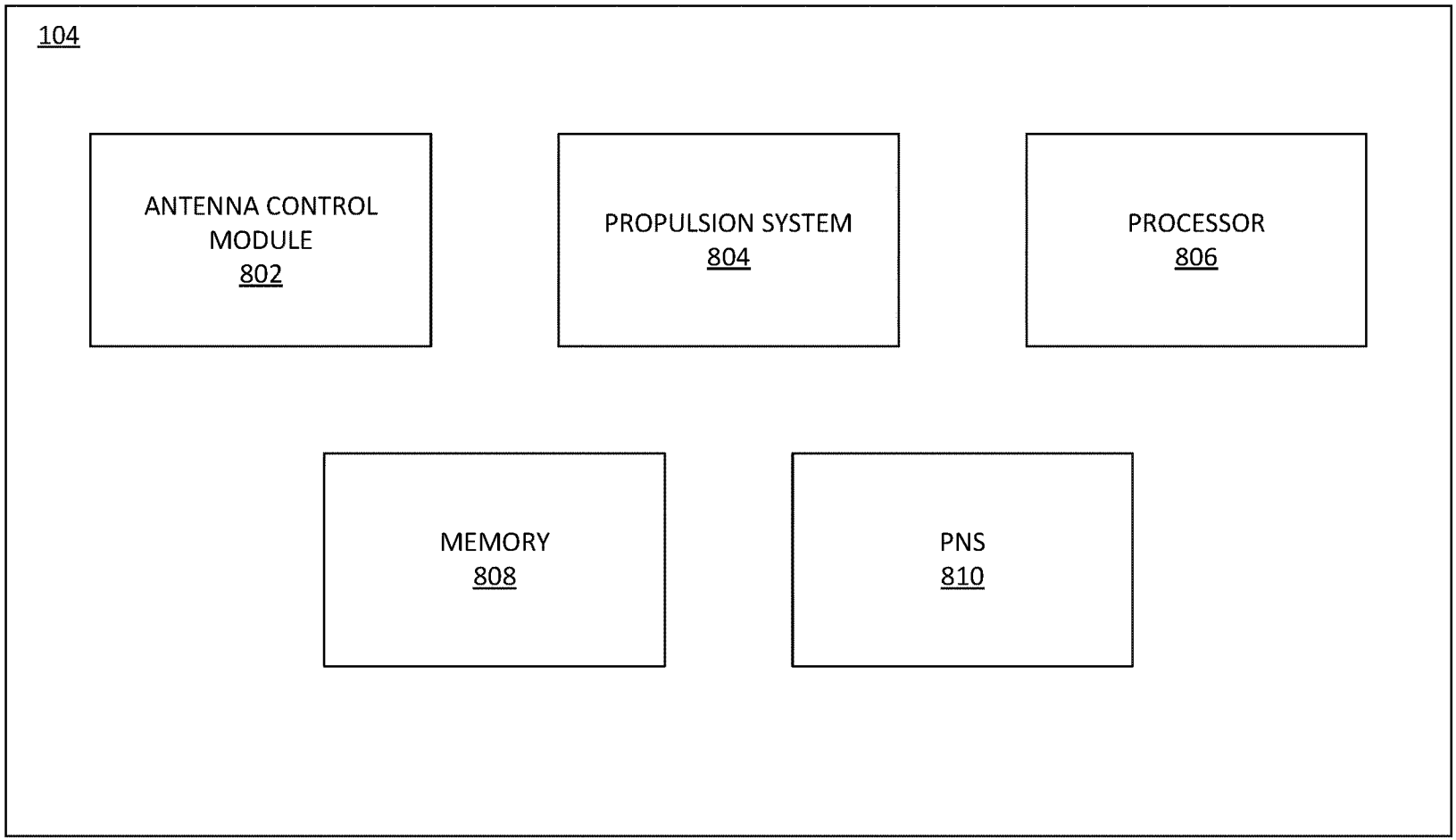
FIG. 8 illustrates select components of an undersea vehicle, in accordance with some embodiments of the present disclosure.

FIG. 8 illustrates components present within undersea vehicle 104, according to some embodiments. Undersea vehicle 104 may include an antenna control module 802, a propulsion system 804, a processor 806, a memory 808, and a precision navigation system (PNS) 810.

Antenna control module 802 can include any circuits and/or instructions stored in memory designed to control when to deploy antenna module 106 and when to stow antenna module 106 back against or close to the hull of undersea vehicle 104. In some embodiments, antenna control module 802 represents a portion of processor 806 designed to control the operations of antenna module 106. In some embodiments, antenna control module 802 also controls the motor included as part of mechanical coupler 304 to actuate the rotational movement of antenna module 106 (e.g., rotated upwards to deploy or rotated downwards to stow).

Propulsion system 804 may include any number of elements involved in moving undersea vehicle 104 once it is submerged. Accordingly, propulsion system 804 may include a motor, a fuel source, and a propeller or jet nozzle. In some examples, the motor can turn the propeller in the water to move undersea vehicle 104. In some other examples, the motor can activate a pump that forces water out of the jet nozzle to move undersea vehicle 104. In another embodiment, the propulsion system may be a passive, buoyancy-based mechanism as used in some types of undersea gliders.

Processor 806 may represent one or more processing units that includes microcontrollers, microprocessors, application specific integrated circuits (ASICs), and field programmable gate arrays (FPGAs). According to some embodiments, processor 806 determines all of the operations performed by undersea vehicle 104. In some embodiments, processor 806 further controls all operations associated with RF system 200.

Memory 808 may represent one or more memory devices that can be any type of memory. The memory devices can be one or more of DDR-SDRAM, FLASH, or hard drives to name a few examples. Navigational routes or any other data may be preloaded into memory 808 before undersea vehicle 104 is submerged. In some embodiments, data received or collected from antenna module 106 are stored in memory 808.

PNS 810 may be included to provide additional data input for determining and/or refining the position of undersea vehicle 104. PNS 810 may include one or more inertial sensors that track movement of undersea vehicle 104.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry.

The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be appreciated, however, that the embodiments may be practiced without these specific details. In other instances, well known operations, components and circuits have not been described in detail so as not to obscure the embodiments. It can be further appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is an antenna module configured to couple with a hull of an underwater vehicle. The antenna module includes a housing configured to enclose a plurality of components including a substrate and one or more spiral antennas on the substrate, and a mechanical coupler connecting the housing to the hull of the underwater vehicle. The housing is configured to rotate, via the mechanical coupler, between a deployed position extending away from the hull of the underwater vehicle and a stowed position against the hull or closer to the hull compared to the deployed position. The substrate includes at least a first plane and a second plane opposite the first plane and each of the one or more spiral antennas comprises a first spiral trace pattern on the first plane and a second spiral trace pattern on the second plane, the first spiral trace pattern coupled to the second spiral trace pattern with one or more vias through the substrate.

Example 2 includes the subject matter of Example 1, wherein the substrate further comprises a third plane between the first plane and the second plane, and each of the one or more spiral antennas comprises an I/O trace on the third plane.

Example 3 includes the subject matter of Example 2, wherein the I/O trace follows a same spiral pattern as the first spiral trace pattern.

Example 4 includes the subject matter of Example 2 or 3, wherein the plurality of components further comprises a UHF/VHF antenna on the third plane.

Example 5 includes the subject matter of any one of Examples 1-4, wherein the housing comprises a fiber-reinforced polymer composite material.

Example 6 includes the subject matter of any one of Examples 1-5, wherein the plurality of components further comprises an insulating material over the substrate.

Example 7 includes the subject matter of Example 6, wherein the insulating material comprises a syntactic foam.

Example 8 includes the subject matter of any one of Examples 1-7, wherein at least one of the one or more spiral antennas is a directional antenna that includes an RF attenuating structure over the first spiral trace pattern or the second spiral trace pattern of the directional antenna.

Example 9 includes the subject matter of any one of Examples 1-8, wherein the one or more spiral antennas are arranged in a row on the substrate.

Example 10 includes the subject matter of any one of Examples 1-9, wherein the substrate and the housing each have a curved shape.

Example 11 includes the subject matter of Example 10, wherein the hull of the underwater vehicle is cylindrical, and wherein the curved shape has a same radius of curvature as the hull.

Example 12 includes the subject matter of any one of Examples 1-11, wherein the plurality of components further comprises one or more GPS antennas on the substrate.

Example 13 includes the subject matter of any one of Examples 1-12, wherein the substrate comprises a flexible material, such that rotation of the housing into the stowed position causes the substrate to flex around a curvature of the hull of the underwater vehicle.

Example 14 is an unmanned underwater vehicle (UUV) comprising the antenna module of any one of Examples 1-13.

Example 15 is an RF system configured for use on an underwater vehicle. The RF system includes an antenna module configured to at least receive an RF signal, front end circuitry configured to receive the RF signal from the antenna module and provide an analog signal, at least one analog to digital converter (ADC) configured to transform the analog signal into a digital signal, and a processor configured to receive the digital signal and execute one or more operations based on the digital signal. The antenna module includes a housing configured to enclose a plurality of components including a substrate and one or more spiral antennas on the substrate, and a mechanical coupler connecting the housing to a hull of the underwater vehicle. The housing is configured to rotate, via the mechanical coupler, between a deployed position extending away from the hull of the underwater vehicle and a stowed position against the hull or closer to the hull compared to the deployed position. The substrate includes at least a first plane and a second plane opposite the first plane and each of the one or more spiral antennas comprises a first spiral trace pattern on the first plane and a second spiral trace pattern on the second plane, the first spiral trace pattern coupled to the second spiral trace pattern with one or more vias through the substrate.

Example 16 includes the subject matter of Example 15, wherein the substrate further comprises a third plane between the first plane and the second plane, and each of the one or more spiral antennas comprises an I/O trace on the third plane.

Example 17 includes the subject matter of Example 16, wherein the I/O trace follows a same spiral pattern as the first spiral trace pattern.

Example 18 includes the subject matter of Example 16 or 17, wherein the plurality of components further comprises a UHF/VHF antenna on the third plane.

Example 19 includes the subject matter of any one of Examples 15-18, wherein the housing comprises a fiber-reinforced polymer composite material.

Example 20 includes the subject matter of any one of Examples 15-19, wherein the plurality of components further comprises an insulating material over the substrate.

Example 21 includes the subject matter of Example 20, wherein the insulating material comprises a syntactic foam.

Example 22 includes the subject matter of any one of Examples 15-21, wherein at least one of the one or more spiral antennas is a directional antenna that includes an RF attenuating structure over the first spiral trace pattern or the second spiral trace pattern of the directional antenna.

Example 23 includes the subject matter of any one of Examples 15-22, wherein the one or more spiral antennas are arranged in a row on the substrate.

Example 24 includes the subject matter of any one of Examples 15-23, wherein the substrate and the housing each have a curved shape.

Example 25 includes the subject matter of Example 24, wherein the hull is cylindrical, and wherein the curved shape has a same radius of curvature as the hull.

Example 26 includes the subject matter of any one of Examples 15-25, wherein the plurality of components further comprises one or more GPS antennas on the substrate.

Example 27 includes the subject matter of any one of Examples 15-26, wherein the substrate comprises a flexible material, such that rotation of the housing into the stowed position causes the substrate to flex around a curvature of the hull.

Example 28 is an unmanned underwater vehicle (UUV) comprising the RF system of any one of Examples 15-27.

Example 29 is an antenna module configured to couple with a hull of an underwater vehicle. The antenna module includes a curved substrate movable between a stowed and deployed position and one or more spiral antennas on the curved substrate. Movement of the substrate into the stowed position causes the substrate to curve around a curvature of the hull of the underwater vehicle. Each of the one or more spiral antennas comprises a first spiral trace pattern on a first plane of the curved substrate and a second spiral trace pattern on a second plane of the curved substrate, the first spiral trace pattern coupled to the second spiral trace pattern with one or more vias through the curved substrate.

Example 30 includes the subject matter of Example 29, further comprising one or more motors for moving the curved substrate between the stowed and the deployed position.

Example 31 includes the subject matter of Example or 30, wherein the curved substrate further comprises a third plane between the first plane and the second plane, and each of the one or more spiral antennas comprises an I/O trace on the third plane.

Example 32 includes the subject matter of Example 31, further comprising a UHF/VHF antenna on the third plane.

Example 33 includes the subject matter of any one of Examples 29-32, wherein the curved substrate is fixed within a curved rigid housing that moves with the curved substrate between the stowed and the deployed position.

Example 34 includes the subject matter of any one of Examples 29-33, wherein at least one of the one or more spiral antennas is a directional antenna.

Example 35 includes the subject matter of any one of Examples 29-34, further comprising one or more GPS antennas on the curved substrate.

Example 36 is an unmanned underwater vehicle (UUV) comprising the antenna module of any one of Examples 29-35.

What is claimed is:

1. An antenna module configured to couple with a hull of an underwater vehicle, the antenna module comprising:

a housing configured to enclose a plurality of components including a substrate comprising at least a first plane and a second plane opposite the first plane, and one or more spiral antennas on the substrate, wherein each of the one or more spiral antennas comprises a first spiral trace pattern on the first plane and a second spiral trace pattern on the second plane, the first spiral trace pattern coupled to the second spiral trace pattern with one or more vias through the substrate, wherein the substrate and the housing each have a curved shape; and a mechanical coupler connecting the housing to the hull of the underwater vehicle, wherein the housing is configured to rotate, via the mechanical coupler, between a deployed position extending away from the hull of the underwater vehicle and a stowed position against the hull or closer to the hull compared to the deployed position.

2. The antenna module of claim 1, wherein the substrate further comprises a third plane between the first plane and the second plane, and each of the one or more spiral antennas comprises an I/O trace on the third plane.

3. The antenna module of claim 2, wherein the I/O trace follows a same spiral pattern as the first spiral trace pattern.

4. The antenna module of claim 1, wherein at least one of the one or more spiral antennas is a directional antenna that includes an RF attenuating structure over the first spiral trace pattern or the second spiral trace pattern of the directional antenna.

5. The antenna module of claim 1, wherein the substrate comprises a flexible material, such that rotation of the housing into the stowed position causes the substrate to flex around a curvature of the hull of the underwater vehicle.

6. An unmanned underwater vehicle (UUV) comprising the antenna module of claim 1.

7. An RF system configured for use on an underwater vehicle, the RF system comprising:

an antenna module configured to at least receive an RF signal;

front end circuitry configured to receive the RF signal from the antenna module and provide an analog signal;

at least one analog to digital converter (ADC) configured to transform the analog signal into a digital signal; and a processor configured to receive the digital signal and execute one or more operations based on the digital signal;

wherein the antenna module comprises a housing configured to enclose a plurality of components comprising a substrate comprising at least a first plane and a second plane opposite the first plane, and one or more spiral antennas on the substrate, wherein each of the one or more spiral antennas comprises a first spiral trace pattern on the first plane and a second spiral trace pattern on the second plane, the first spiral trace pattern coupled to the second spiral trace pattern with one or more vias through the substrate; and a mechanical coupler connecting the housing to a hull of the underwater vehicle, wherein the housing is configured to rotate, via the mechanical coupler, between a deployed position extending away from the hull of the underwater vehicle and a stowed position against the hull or closer to the hull compared to the deployed position;

wherein at least one of the one or more spiral antennas is a directional antenna that includes an RF attenuating structure over the first spiral trace pattern or the second spiral trace pattern of the directional antenna.

8. The RF system of claim 7, wherein the substrate further comprises a third plane between the first plane and the second plane, and each of the one or more spiral antennas comprises an I/O trace on the third plane.

9. The RF system of claim 8, wherein the I/O trace follows a same spiral pattern as the first spiral trace pattern.

10. The RF system of claim 7, wherein the substrate and the housing each have a curved shape.

11. The RF system of claim 7, wherein the substrate comprises a flexible material, such that rotation of the housing into the stowed position causes the substrate to flex around a curvature of the hull.

12. An unmanned underwater vehicle (UUV) comprising the RF system of claim 7.

13. An antenna module configured to couple with a hull of an underwater vehicle, the antenna module comprises:

a curved substrate movable between a stowed and deployed position, such that movement of the substrate into the stowed position causes the substrate to curve around a curvature of the hull of the underwater vehicle; and one or more spiral antennas on the curved substrate, wherein each of the one or more spiral antennas comprises a first spiral trace pattern on a first plane of the curved substrate and a second spiral trace pattern on a second plane of the curved substrate, the first spiral trace pattern coupled to the second spiral trace pattern with one or more vias through the curved substrate.

14. The antenna module of claim 13, further comprising one or more motors for moving the curved substrate between the stowed and the deployed position.

15. The antenna module of claim 13, wherein the curved substrate further comprises a third plane between the first plane and the second plane, and each of the one or more spiral antennas comprises an I/O trace on the third plane.

16. The antenna module of claim 13, wherein the curved substrate is fixed within a curved rigid housing that moves with the curved substrate between the stowed and the deployed position.

17. The antenna module of claim 13, wherein at least one of the one or more spiral antennas is a directional antenna.

18. An unmanned underwater vehicle (UUV) comprising the antenna module of claim 13.

* * * * *